US006692004B2

(12) United States Patent
Reese

(10) Patent No.: US 6,692,004 B2
(45) **Date of Patent: *Feb. 17, 2004**

(54) GAME PLAYING APPARATUS

(75) Inventor: Peter J. Reese, Vancouver (CA)

(73) Assignee: Peter J. Reese Architect Ltd., Vancouver, BC (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/773,504

(22) Filed: Feb. 2, 2001

(65) Prior Publication Data

US 2001/0042959 A1 Nov. 22, 2001

Related U.S. Application Data

(63) Continuation-in-part of application No. 09/575,450, filed on May 22, 2000, now Pat. No. 6,332,613.

(51) Int. Cl.[7] ..... A63F 1/00
(52) U.S. Cl. ..... 273/292; 273/243
(58) Field of Search ..... 273/236, 241, 273/242, 243, 282.1, 282.3, 283, 284, 282, 299–302, 287, 292

(56) References Cited

U.S. PATENT DOCUMENTS

| | | | | | |
|---|---|---|---|---|---|
| 2,214,167 | A | * | 9/1940 | Hohn | 273/258 |
| 3,672,680 | A | * | 6/1972 | Grey | 273/242 |
| 3,834,709 | A | * | 9/1974 | Lamb | 273/246 |
| 4,026,557 | A | * | 5/1977 | LeBrun et al. | 273/243 |
| 4,173,347 | A | * | 11/1979 | Field, II | 273/261 |
| 4,881,740 | A | * | 11/1989 | Odhner | 273/248 |
| 5,193,818 | A | * | 3/1993 | Leeson | 463/10 |
| 5,607,160 | A | * | 3/1997 | Stevens et al. | 273/249 |
| 5,758,877 | A | * | 6/1998 | Liddell | 273/249 |
| 6,209,871 | B1 | * | 4/2001 | Butler | 273/236 |
| 6,332,613 | B1 | * | 12/2001 | Reese | |

* cited by examiner

*Primary Examiner*—Benjamin H. Layno
*Assistant Examiner*—Vishu K Mendiratta
(74) *Attorney, Agent, or Firm*—Elbie R. de Kock

(57) ABSTRACT

A set of cards for playing a game is provided. Each card has items selected from a predetermined category printed thereon. The category is identified on the card and items are arranged in subgroups according to different degrees of difficulty regarding their perceived recognizability as being members of a set falling within the category. A board which may be used for playing a game using the cards is also provided.

14 Claims, 11 Drawing Sheets

GAME PLAYING APPARATUS

CROSS REFERENCE TO RELATED APPLICATION

This application is a continuation-in-part of U.S. patent application Ser. No. 09/575,450 filed May 22, 2000, now U.S. Pat. No. 6,332,613 the entire contents of which is incorporated herein by reference.

FIELD OF THE INVENTION

This invention relates to a game. In particular it relates to a word game which can be played with a set of cards or with a set of cards in combination with a board.

SUMMARY OF THE INVENTION

According to the invention there is provided a game playing apparatus comprising a set of cards, each card having printed thereon items selected from a predetermined category, which category is identified on the card and wherein the items are arranged in subgroups according to different degrees of difficulty regarding their perceived recognisability as being members of a set falling within the category.

The game playing apparatus may further comprise a board and a plurality of playing pieces for placement on the board during play of the game for tracking the progress of the game, wherein the board is demarcated into a number of playing areas, each playing area being subdivided into a plurality of playing spaces, the playing areas being arranged in partially overlapping relationship, whereby the playing areas have at least some of said playing spaces in common.

Also according to the invention there is provided a game playing apparatus comprising a board and a plurality of playing pieces for placement on the board during play of the game for tracking the progress of the game, wherein the board is demarcated into a number of playing areas, each playing area being subdivided into a plurality of playing spaces, the playing areas being arranged in partially overlapping relationship, whereby the playing areas have at least some of said playing spaces in common, and wherein the playing areas are colour-coded to distinguish the playing areas from one another and each playing area is provided with a set of said playing pieces which is correspondingly colour-coded.

Further objects and advantages of the invention will become apparent from the description of preferred embodiments of the invention below.

BRIEF DESCRIPTION OF THE DRAWINGS

The invention will now be described by way of examples with reference to the accompanying drawings, in which.

DETAILED DESCRIPTION OF PREFERRED EMBODIMENT

Figure 1:
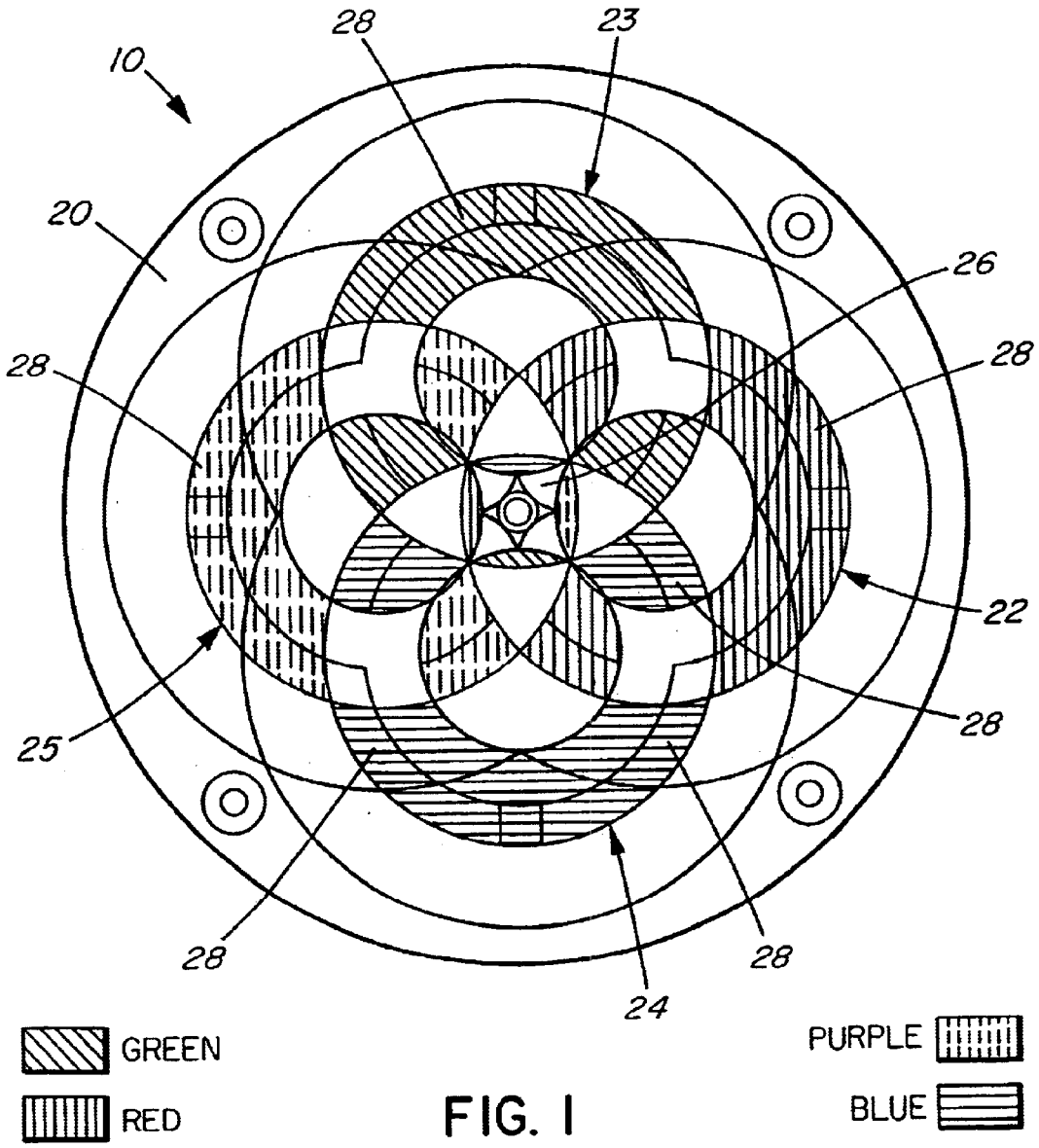
FIG. 1 is a plan view of a board for playing a board game.
Figure 3:
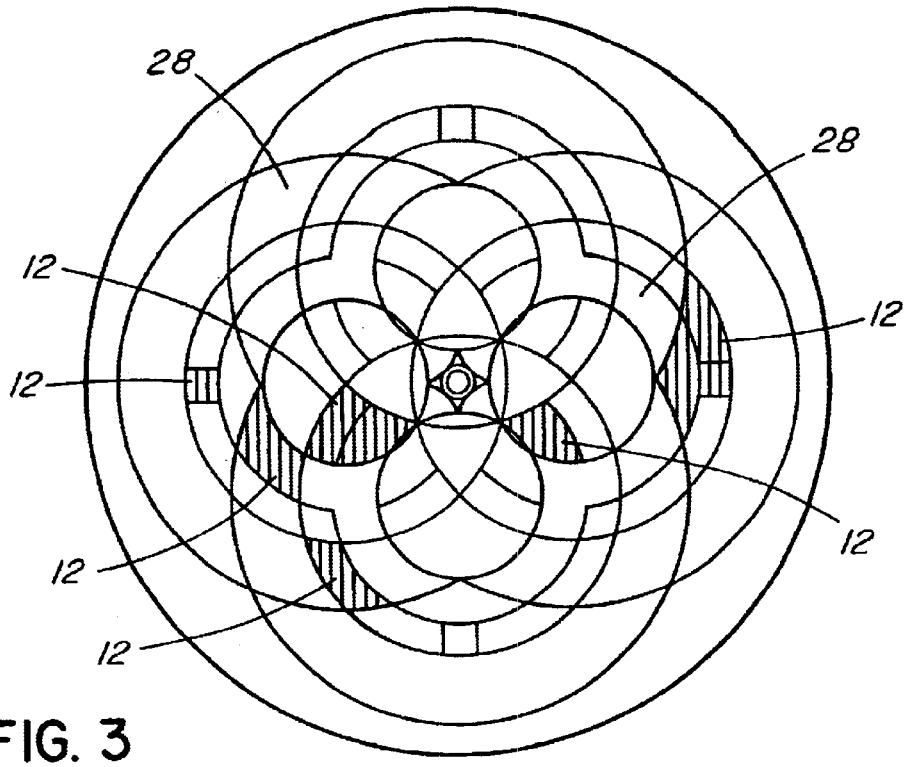
FIG. 3 is a view of the board of FIG. 1 showing an example after one round of play, as played by four sides.
Figure 4:
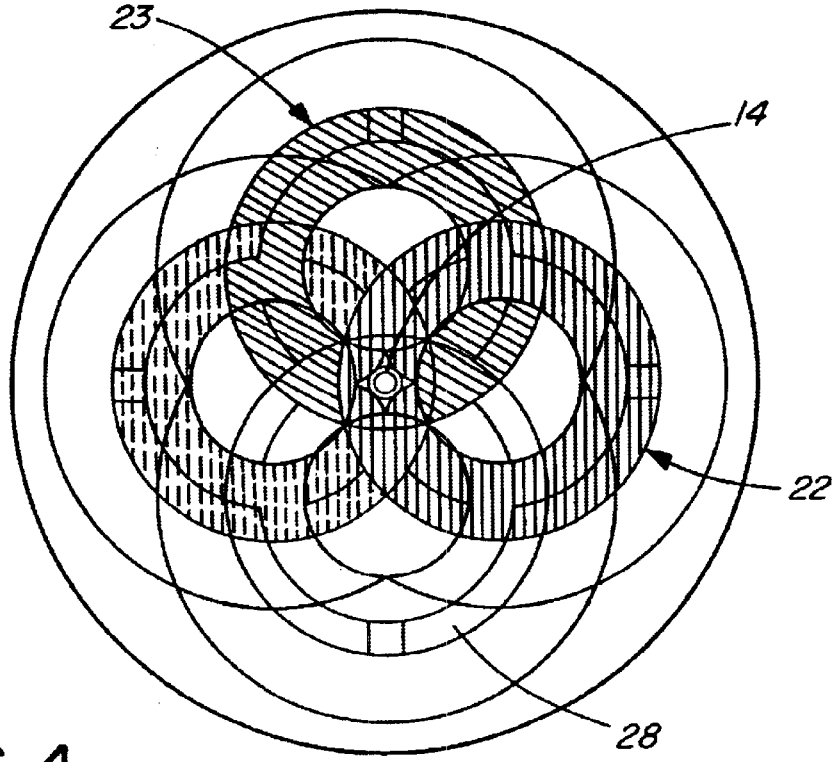
FIG. 4 is a view of the board of FIG. 1 showing an example of the board as at the game's end when played by three sides, with the side represented by the unbroken annular playing area having won the game.
Figure 5:
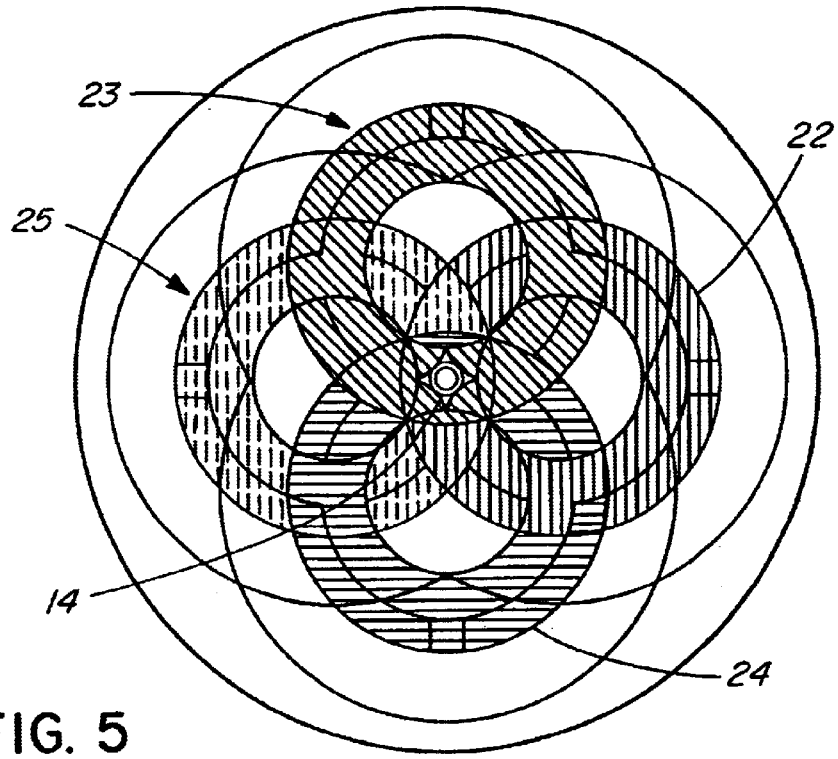
FIG. 5 is a view of the board of FIG. 1 showing an example of the board as at the game's end when played by four sides, with the side represented by the unbroken annular playing area having won the game.
Figure 6:
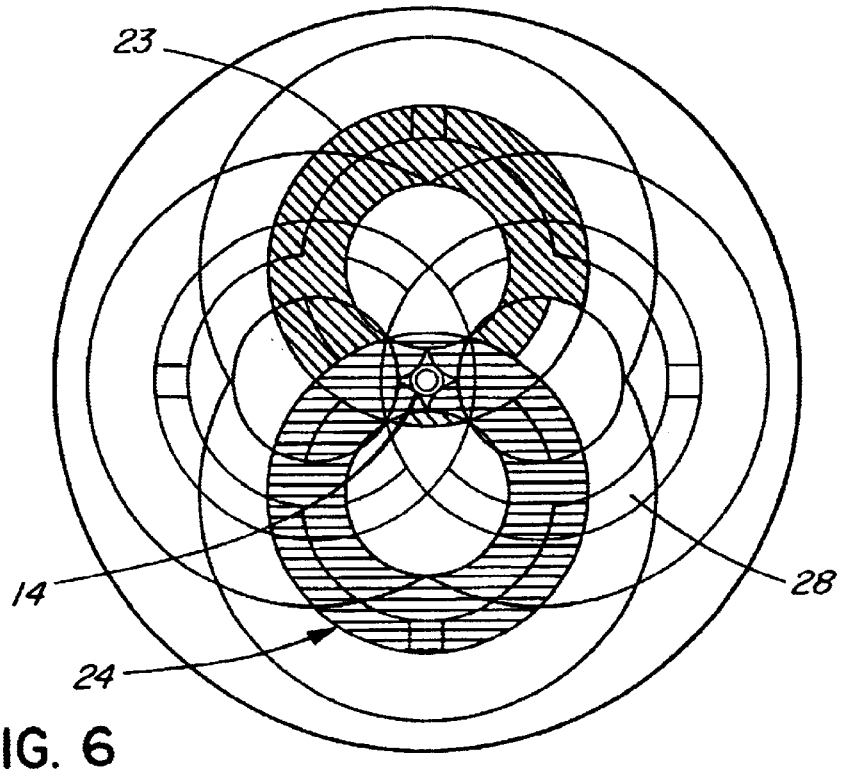
FIG. 6 is a view of the board of FIG. 1 showing an example of the board as at the game's end when played by two sides with the side represented by the unbroken annular playing area having won the game.
Figure 7:
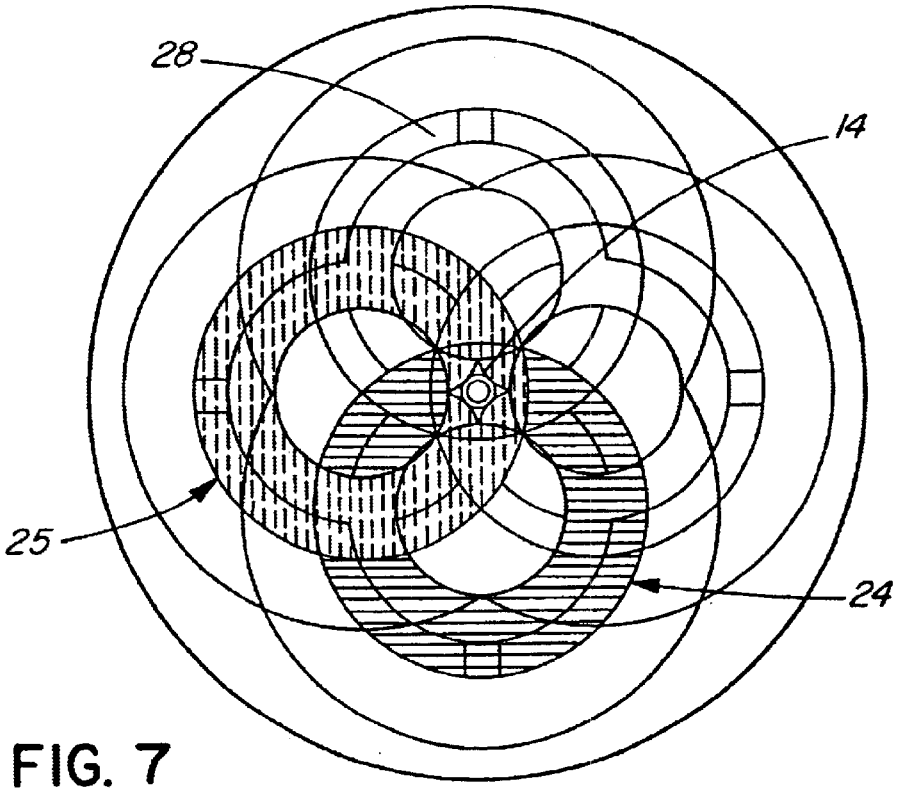
FIG. 7 is a view of the board of FIG. 1 showing an example of the board as at the game's end when played by two sides with the side represented by another unbroken annular playing area having won the game.

In the present example apparatus for playing a board game comprises a board, generally indicated by the reference numeral 10 in FIG. 1, and a plurality of different playing pieces, indicated by the reference numeral 12 in FIG. 3, the drawing being a demonstrative example of some of the playing pieces 12 placed on the board 10 during the course of play.

The board 10 is circular in shape and comprises a playing surface 20 with four playing areas 22, 23, 24 and 25 demarcated thereon. The playing areas 22 to 25 are in the form of partially overlapping annular formations or rings. A central playing area 26 is formed at a location where all four of the playing areas 22 to 25 overlap. As can be seen, the annular playing areas 22 to 25 are quadrantically arranged with respect to the central playing area 26.

In order to distinguish the playing areas 22 to 25 from each other, they are colour-coded, e.g. they are coloured red(22), green(23), blue(24) and purple(25). Different hatchings are used in FIG. 1 (as well as in FIGS. 4 to 7) to indicate the different colours as per the key provided with FIG. 1.

Each playing area 22 to 25 is further subdivided into twenty five abutting playing spaces 28 for receiving the playing pieces 12 during the course of playing the game, as will be described below. A matching playing piece 12 is provided for each playing space 28.

If desired, the playing spaces 28 may be recessed to snugly receive the playing pieces 12.

Figure 2:
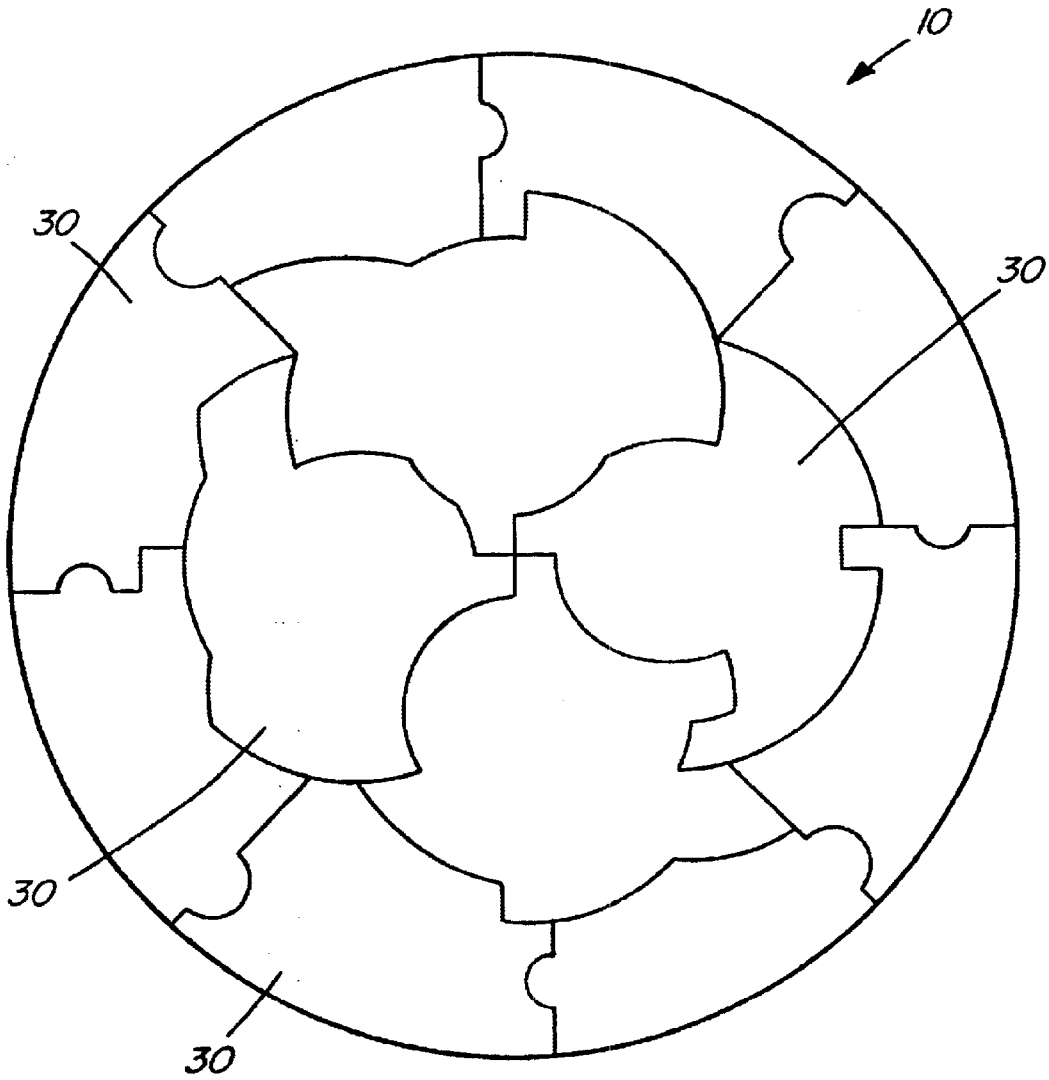
FIG. 2 is a view similar to FIG. 1 but showing the board comprising twelve interlocking sections which can be dismantled for storage purposes.

In order to facilitate storage, the board 10 is provided in the form of a number of interlocking segments 30, as shown in FIG. 2, to provide for disassembly of the board 10.

However, the board 10 may also be displayed on a computer screen or monitor and provided with suitable software simulating the apparatus for playing the game so that the game may be played electronically, e.g. by a group of players at one location or by players at different locations using the internet.

Figure 11:
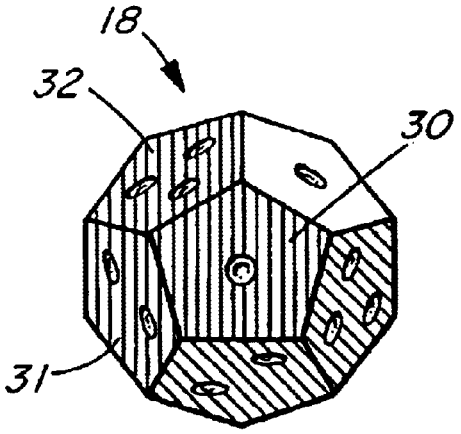
FIG. 11 is a three-dimensional view of a dodecahedronal die for use in playing the board game.

A dodecahedronal die 18, as shown in FIG. 11, may also be provided. The die 18 has four groups of plane faces, each group comprising three angularly abutting plane faces 30, 31 and 32. Each group of plane faces is colour coded, being respectively red, green, blue and purple to correspond with the colours of the playing areas 22 to 25.

Each plane face 30, 31, 32 has a marking for score identification, the first plane face 30 having one dot, the second plane face 31 having two dots and the third plane face 32 having three dots. Thus, when the die is thrown by a side of a particular colour, the score on a correspondingly coloured face is taken into account for that side.

Figure 8:
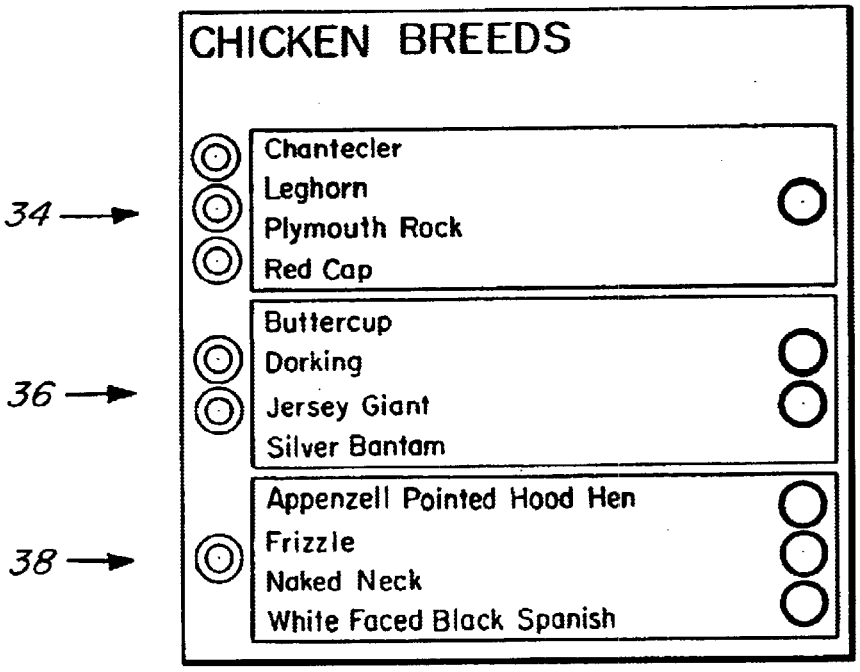
FIG. 8 shows the one side of a word card for use in playing the board game, depicting nouns selected from the category "Chicken Breeds", which nouns are subcategorized into three subgroups of four nouns per subgroup.

A number of word cards 16, as shown in FIG. 8, is also provided. Each word card 16 has one or more words printed thereon. The words constitute a topic or subject category which is identified by a heading at the top of the card 16, such as "Chicken Breeds" in the present example.

Different subject categories are provided on the cards 16. The subject categories are intended to tap randomly into the entire human body of knowledge and may comprise the inanimate world, life forms; places; things; people; cultural manifestations; cultural productions; names and terms; or any other subject.

Each card 16 contains a particular category. Each category is further subcategorized into subgroups of increasing difficulty, e.g. a number of topics 34 probably known to a player, topics 36 possibly known to a player and topics 38 probably not known to a player, as shown in FIG. 8.

In the present example the word cards 16 comprise a set of 360 word cards 16, provided as ten packs of cards 16, each pack comprising thirty-six cards 16. The cards 16 of each pack respectively have words from one of the subject groups printed thereon, e.g. if there are ten different categories, each pack has three cards from each category.

To facilitate identification, the cards 16 of the different categories may be colour coded with a distinctive colour for each category.

The playing pieces 12 are shards matching the playing spaces 28 on each of the playing areas 22 to 25. The playing pieces or shards 12 are provided as four differently coloured sets, i.e. red, green, blue and purple, to match the playing spaces 28.

Figure 14:
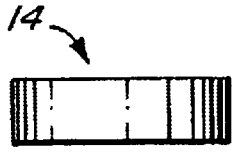
FIGS. 14 and 15, respectively show a side view and a plan view of a ring for use in playing the board game.
Figure 15:
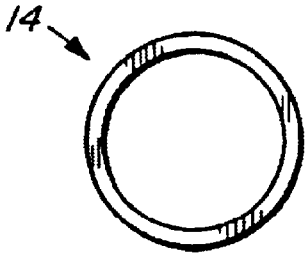

A ring 14, as shown in FIGS. 14 and 15, for use in playing the game, is also provided. The ring 14 is of brass and has a diameter of about 24 mm.

Figure 9:
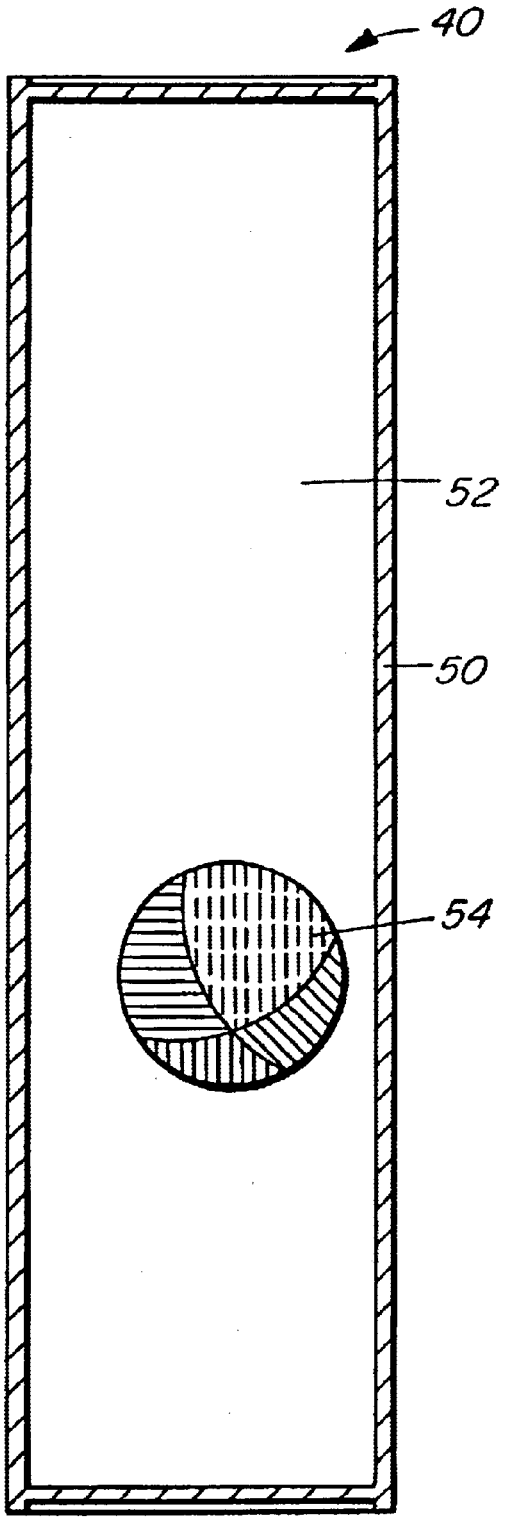
FIG. 9 shows a longitudinal section of a timer for use in playing the board game.
Figure 10:
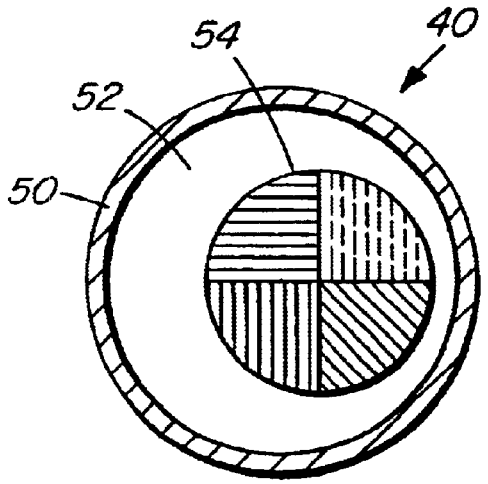
FIG. 10 shows a cross-section of the timer of FIG. 9.

A timer 40 (FIGS. 9 and 10) for determining the length of time permitted for executing certain actions during play of the game is also provided.

The timer 40 comprises a cylindrical container 50 which is of a transparent plastic material, such as lucite. The container 50 is filled with a clear viscous liquid 52, e.g. water, with a plastic ball 54 in the liquid 52. The ball 54 has a specific gravity which causes it to rise through the liquid 52 from the bottom to the top of the container 50 in a predetermined amount of time, e.g. one minute. The ball 54 is multicolored to match the colours of the playing areas 22 to 25, for decorative purposes.

In the present example the container 50 has a height of 151 mm, an outside diameter of 39 mm and a wall thickness of 2 mm. The ball 54 has a diameter of 23 mm.

Figure 12:
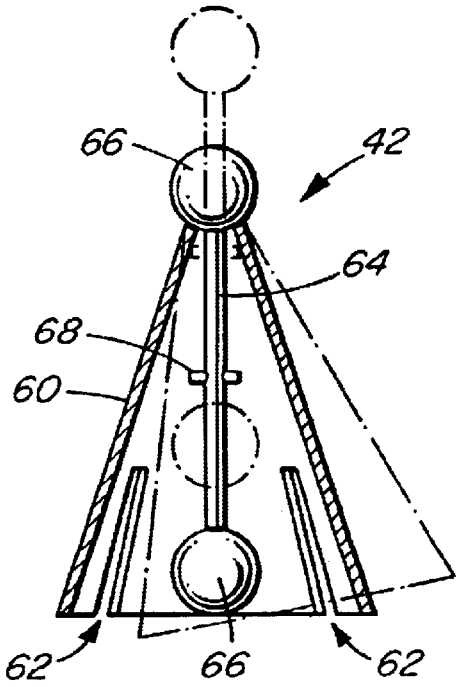
FIGS. 12 and 13 respectively show a section and plan view of a bell for use in playing the board game.
Figure 13:
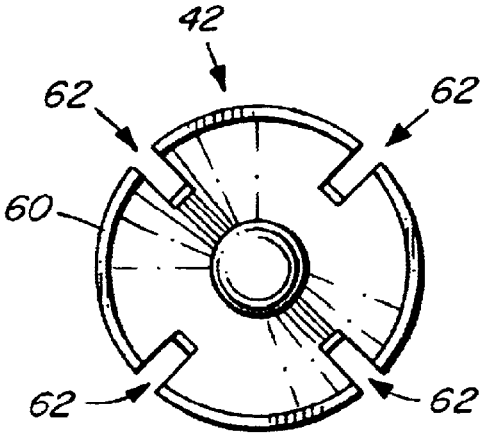

A bell 42, as shown in FIGS. 12 and 13, is further provided to signal the termination of a time period. It comprises a brass cone 60 provided with four slots 62 extending from its base. A brass rod 64 having a brass ball 66 at each of its opposite ends is suspended through a hole at the apex of the cone 60. A transverse brass stub 68 is located at the centre of the rod 64. The bell 42 is lifted by means of the ball 66 at the upper end of the rod 60 in order to ring it.

Figure 16:
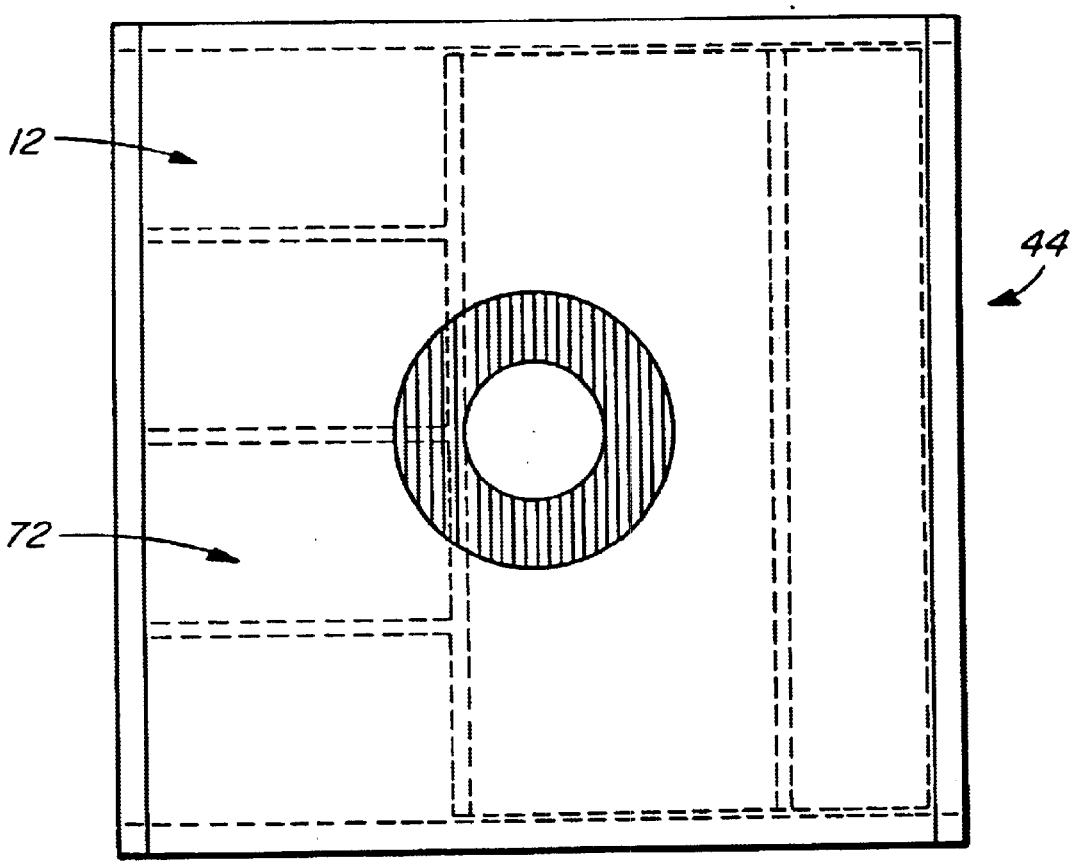
FIGS. 16 and 17, respectively show a plan view and side view of a container for the board game.
Figure 17:
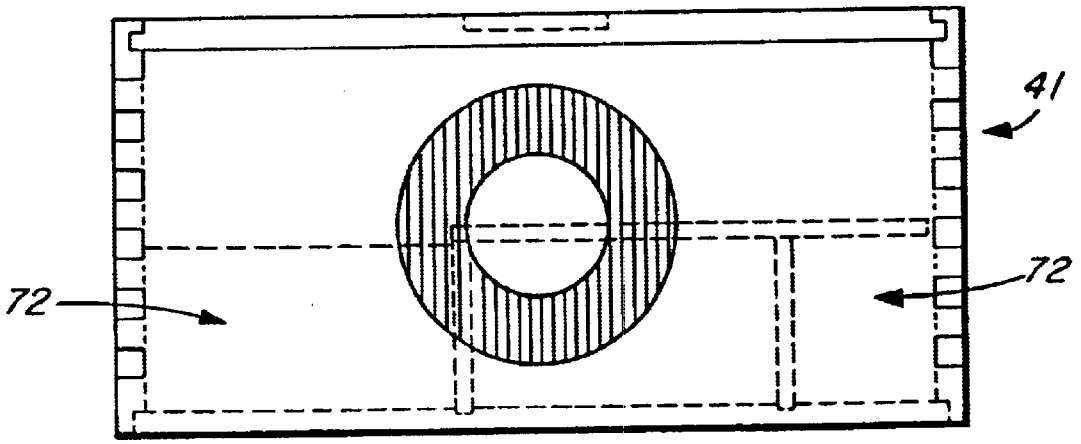

A container 44 (FIGS. 16 and 17) for storing the board game apparatus is also provided. As shown, the container 44 is provided with compartments 72 for storing the various pieces.

In playing the board game 10, the players arrange themselves into two, three or four sides around the assembled board 10. Each side plays the colour of the playing area 22 to 25 nearest it. The pack of word cards 16 to be used for playing the game is shuffled and the pack placed face down within reach of the sides. Each side is issued twenty-five shards 12 corresponding in colour to the playing area 22 to 25 of each side.

The game is played in rounds. At each round, each side is both "Hander" and "Fingerer".

Each side in turn selects a word card 16 from the top of the pack of the word cards 16 and prevents the other side(s) from viewing the word card 16. The die 18 can be cast to decide the order in which the sides are to select a card 16. For example, the first colour uppermost corresponding with the colour of a playing area of one of the sides playing, determines that that side can be the first to select a card. The second and third in order can be selected in similar fashion.

If there are two sides, each side plays against the other at each round. If there are three or four sides, each side alternates playing against the other sides in a regular order. The intent is that each side plays an equal number of rounds against the other side. For example, if there are three sides, each side would alternate being a Hander to the side on its left and Fingerer to the side on its right during a first round, and then reverse during the next round. Where there are four sides, two sides would play against each other in a predetermined order such as blue versus purple and red versus green during the first round, then in the next round, blue versus green and purple versus red and finally blue versus red and purple versus green in the third round and then repeat the order.

In each round, once each side has selected and reviewed a word card 16, each side selects a subgroup 34, 36, 38. With reference to, for example, the word card depicted in FIG. 8, only three of the four chicken breeds of the category 34, 36 or 38 are selected. The side with the example card then adds a fourth breed as a "Ringer", which is a contrived word, to the three selected breeds. The intent is that the Ringer should be a deceptive representation of being a member of the subgroup 34, 36, 38. In the above example, the three breeds selected from the category 34, 36 or 38 together with the Ringer are notated on note paper. The timer 40 and bell 42 may be used to limit the length of time allotted to each side for this purpose.

Taking turns, a Hander reads the name of the topic or subject category on the word card 16 to its Fingerer. For example, and again referring to FIG. 8, the name of the category is "Chicken Breeds". The Fingerer is handed the note paper containing the four chicken breeds for review. The Fingerer then selects one of the four breeds on the note paper as being the Ringer. At the end of each round, each Fingerer in turn announces to their Hander their selection of the item considered to be the Ringer.

As stated above, for each round, a side is both a Hander and a Fingerer. Therefore, if red is playing against green, red hands green its card and green hands red its card. Each side then tries to finger the other's Ringer.

According to the preferred method of playing the board game 10, the intent is that the Ringer should not be a member of the particular subject category 34, 36, 38. If the Fingerer can show that the Ringer, although not one of those on the word card 16, does fall within the subject category identified on the word card 16, the Hander will be penalized with three points.

For each point awarded to a side on the scoring basis set out below, a side may place one shard 12 on a playing space 28 of that side's playing area 22, 23, 24 or 25. Once placed, a shard 12 may not be moved, except by another side, as described below. Shards 12 are placed on the playing area 22, 23, 24, 25 in the order of the points gained in a particular round, with the side gaining the most points going last. If there is a tie in the points gained, the order of placing of the shards 12 may be decided by the cast of the die 18.

If a side's shard 12 is to be placed by one side on an area of overlap where there is already a shard 12 of another side, the one side may remove the other side's shard 12 and replace it with its own.

On completion of each round, the word cards 16 which have been used are returned face down to the bottom of the pack of word cards 16 used during play.

At some point one side will complete placing all twenty-five shards on its playing area 22, 23, 24 or 25. Once a side has completed placing all its shards 12, a brass-ring round proceeds. This round is similar to a normal round except that the side attempting to place the ring 14 on the central playing area 26, casts the die to determine which group 34, 36, 38 on the word card 16 selected by that side's Hander will be used. The side attempting to place the ring 14 gets the first chance to attempt to identify the Ringer of that side's Hander. If the side correctly identifies the Ringer, the ring 14 is placed on the central area 26 and the game is won by the side so placing the ring 14.

The first group 34 of topics on the word card 16 is valued at three points to the Hander if the Fingerer fails to identify the Ringer and is valued at one point to the Fingerer if the Fingerer correctly identifies the Ringer.

The second group 36 on the word card 16 is valued at two points to the Hander if the Fingerer fails to identify the Ringer and is valued at two points to the Fingerer if the Ringer is identified by the Fingerer.

The third category 38 on the word card 16 is valued at one point to the Hander if the Fingerer fails to select the Ringer and is valued at three points to the Fingerer if the Fingerer correctly identifies the Ringer.

One point is required to place a shard 12 on a playing space 28.

In accordance with the scoring as described above, each side can score from 0 to 6 points per round.

Figure 18:
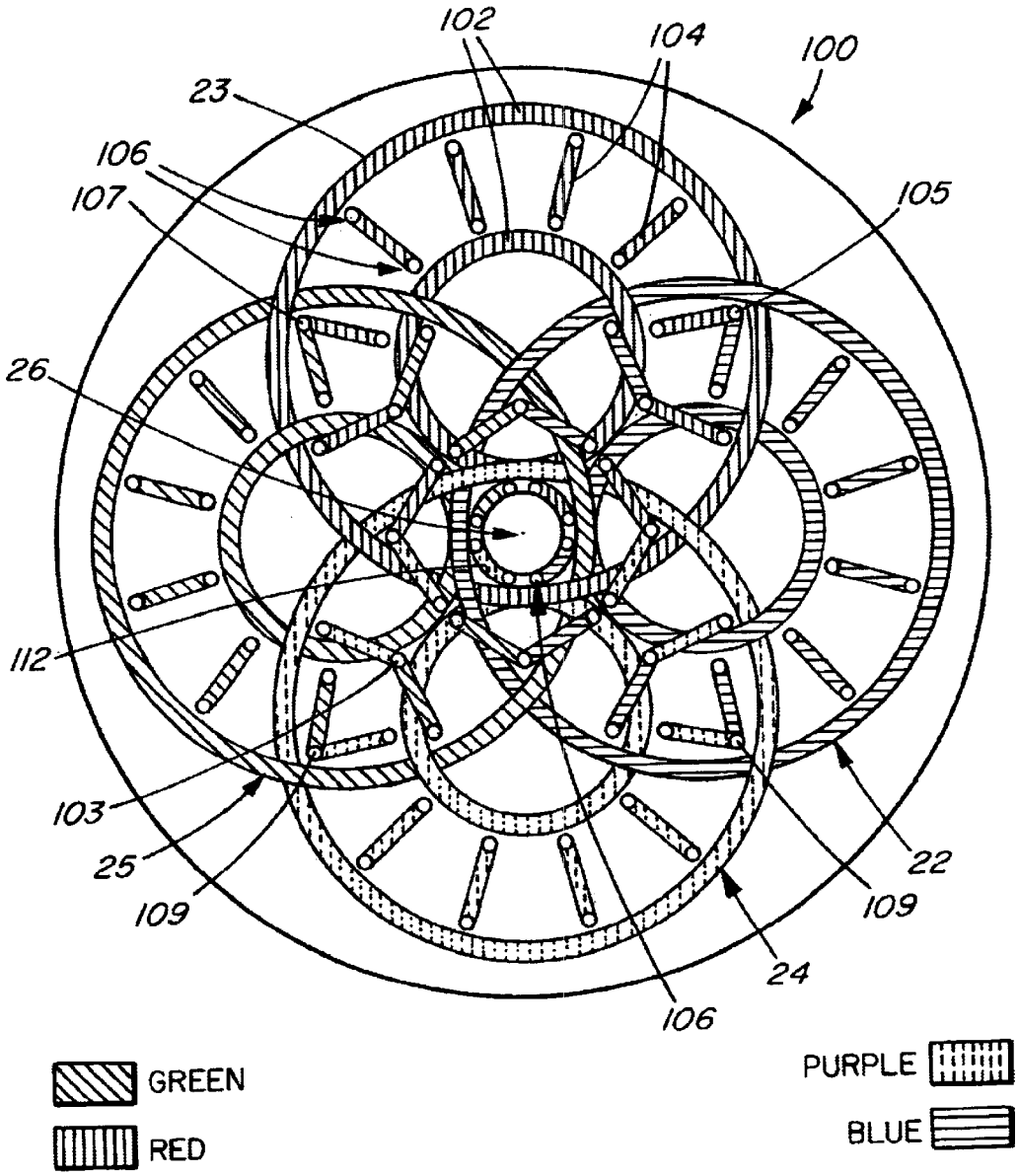
FIG. 18 is a plan view of another board for playing a board game.

Referring now to FIG. 18, another embodiment 100 of a board for a board game is shown.

Figure 19A:
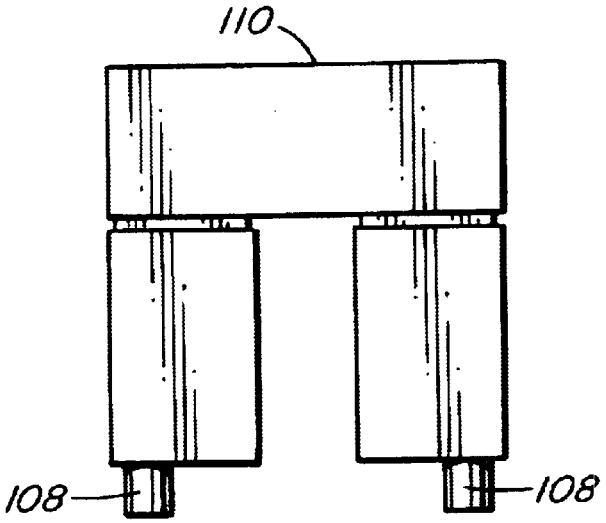
FIGS. 19A, B and C are front, side and plan views, respectively, of a playing piece for use with the board of FIG. 18.
Figure 19B:
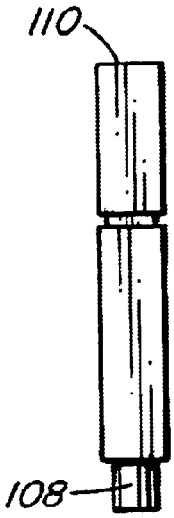
Figure 19C:
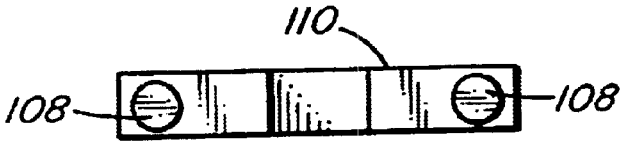

Like the board 10 in FIG. 1, the board 100 also has four playing areas 22, 23, 24 and 25 which are in the form of partially overlapping annular formations or rings. It also has a central playing area 26 where all four of the playing areas 22 to 25 overlap. In this example, the playing areas 22 to 25 are coloured blue, red, purple and green, respectively, as shown in the key provided with FIG. 18. As shown, each of the playing areas is depicted by a coloured pair of concentric circles 102 with radially extending bar-shaped playing spaces 104 between the circles 102. The circles 102 and playing spaces 104 of each of the playing areas 22 to 25 are in the colour of that playing area. Sockets or holes 106 are provided at the opposite ends of each of the playing spaces 104 for receiving mating pins 108 which are provided on playing pieces 110 shown in FIGS. 19A, B and C. In this example, each playing piece 110 is in the form of an inverted "U" but it will be appreciated that any suitable shape may be used.

Instead of the abutting playing spaces 28 of the board 10 for receiving matching playing pieces 12, the playing pieces 110 of the present embodiment are located on the playing spaces 104. Ten playing spaces 104 with ten matching, i.e. similarly coloured, playing pieces 110 are provided for each of the playing areas 22 to 25.

As can be seen, some of the playing spaces 104 of the overlapping playing areas 22 to 25 have a pin socket 106 in common, as shown for example at 103, 105, 107 and 109 in FIG. 18. At these locations only a playing piece 110 of the one or the other side can be accommodated and the overlapping playing areas 22 to 25 are said to have these playing spaces in common. In the present example, it can be seen that each of the playing areas 22 to 25 has two playing spaces 104 in common with each of the other playing spaces 22 to 25.

Figure 20A:
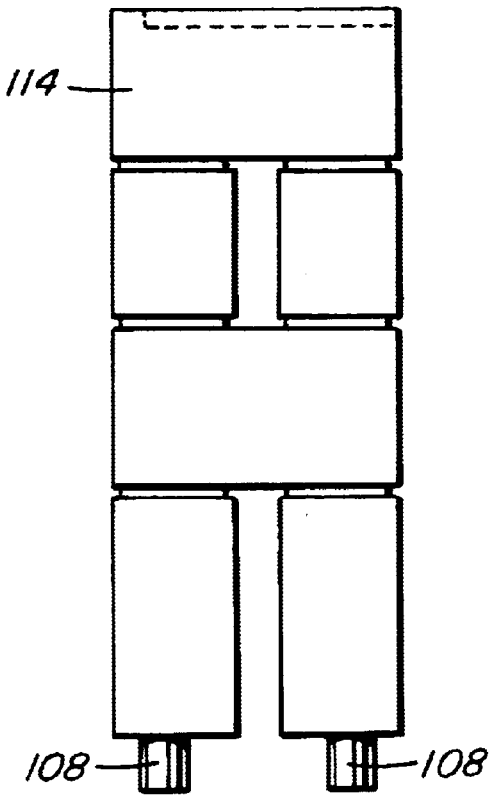
FIGS. 20A, B and C are front, side and plan views, respectively, of a centre piece for use with the board of FIG. 18.
Figure 20B:
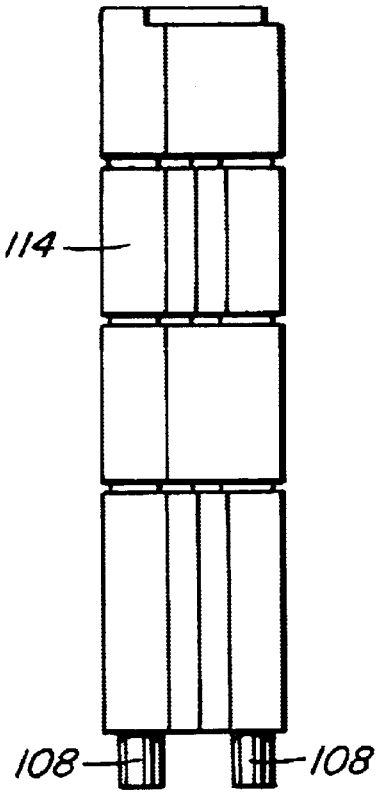

The central playing area 26 is surrounded by four curved playing spaces 112, one for each of the playing areas 22 to 25 and matching the colour of its playing area. The curved playing spaces 112 are also provided with openings 106 at their opposite ends. This is to receive the matching pins 108 of centre playing pieces 114, as shown in FIGS. 20A, B and C. The pieces 114 are curved in plan view to fit the corresponding playing space 112 on which it is to be located.

Figure 20C:
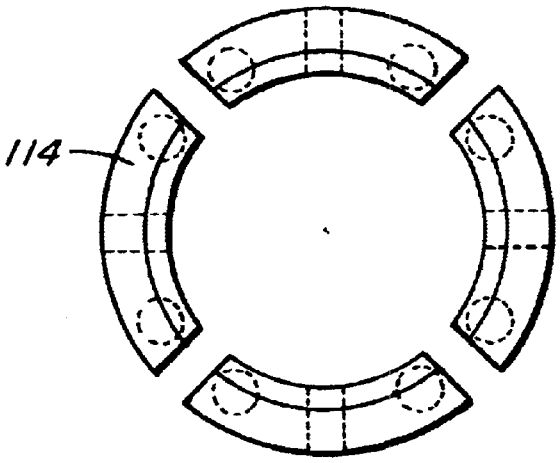

The centre playing pieces 114 are used instead of the ring 14, i.e. the winning side will locate its centre playing piece 114 on its corresponding playing space 112 instead of placing the ring 14 in the central playing area 26. Therefore, at the end of each game only one of the centre playing pieces 114 will be located in place on its corresponding playing space 112. In FIG. 20C all four of the centre playing pieces 114 are shown in position on the playing spaces 112 for illustrative purposes only.

The game is played using the pack of word cards 16 as with the board 10. As before, for each point awarded to a side, it may place one playing piece 110 on a playing space in its playing area 22, 23, 24, 25. Once placed, the piece 110 may not be moved, except by another side if it is in a location where the playing areas 22, 23, 24, 25 overlap.

The pieces 110 are placed in the playing areas 22, 23, 24, 25 in the order of the points gained in a particular round, with the side gaining the most points going last. If there is a tie in the points gained, the order of placing the pieces 110 may be decided by the cast of a die.

If a side's piece 110 is to be placed by one side on a playing space 104 which has a pin socket 106 in common with a playing space 104 of the overlapping playing area, e.g. as at 105, where there is already a piece 110 of another side, the one side may remove the other side's piece 110 and replace it with its own.

At some point one side will complete placing all ten of its pieces 110 on its playing area 22, 23, 24 or 25. When this happens, the final round of the game proceeds in similar fashion as the brass ring round of the game when using the board 10, except that, instead of using the ring 14, the centre playing piece 114 of the winning side is used, as described above.

Although certain preferred embodiments of the present invention have been shown and described in detail, it should be understood that various changes and modifications may be made therein without departing from the scope of the appended claims.

We claim:

1. Game playing apparatus comprising a set of cards, each card having printed thereon items selected from a predetermined category, which items are all true and verifiable members of that category, and which category is identified on the card and wherein the items are arranged in subgroups, each subgroup comprising a plurality of said items, the items being arranged in the subgroups according to different degrees of difficulty as determined by their recognisability as being members of the category, wherein items in one of said subgroups are more easily recognisable as being members of the category than items in another one of said subgroups and wherein the different degrees of difficulty are indicated on the card by discriminate placement of the subgroups on the card and by signifiers indicating points to be awarded to two opposing sides playing the game.

2. The game playing apparatus of claim 1, further comprising a board and a plurality of playing pieces for placement on the board during play of the game for tracking the progress of the game, wherein the board is demarcated into a number of playing areas, each playing area being subdivided into a plurality of playing spaces, the playing areas being arranged in partially overlapping relationship, whereby the playing areas have at least some of said playing spaces in common.

3. The game playing apparatus of claim 2, wherein the playing areas are colour-coded to distinguish the playing areas from one another and each playing area is provided with a set of said playing pieces which is correspondingly colour-coded.

4. The game playing apparatus of claim 3, wherein the playing spaces of each colour-coded playing area correspond in number with the correspondingly colour-coded set of playing pieces.

5. The game playing apparatus of claim 4, wherein at least some of the playing spaces of each colour-coded playing area have different shapes and wherein a correspondingly shaped playing piece is provided for each of said playing spaces of each colour-coded playing area.

6. The game playing apparatus of claim 2, wherein said playing areas are annular-shaped.

7. The game playing apparatus of claim 6, wherein the number of said playing areas is four.

8. The game playing apparatus of claim 7, wherein said playing areas form a common area of overlap where all four of the playing areas are arranged in overlapping relationship, the playing areas being symmetrically arranged relative to said common area of overlap.

9. The game playing apparatus of claim 2, wherein the board is displayed on a computer screen or monitor.

10. The game playing apparatus of claim 2, wherein each playing area is defined between a pair of concentric circles and the playing spaces extend radially between the concentric circles.

11. The game playing apparatus of claim 10, wherein said playing spaces in common comprise a pair of playing spaces which intersect with each other.

12. The game playing apparatus of claim 11, wherein said playing spaces and playing pieces have mating formations for locating the playing pieces in position on the playing spaces.

13. The game playing apparatus of claim 12, wherein said mating formations comprise pins on the playing pieces and sockets on the playing spaces.

14. The game playing apparatus of claim 13, wherein said playing spaces in common have a socket in common.

* * * * *